US010772168B2

(12) United States Patent
Yang et al.

(10) Patent No.: US 10,772,168 B2
(45) Date of Patent: Sep. 8, 2020

(54) LED DRIVING CIRCUIT AND DRIVING METHOD THEREOF

(71) Applicant: SHAANXI REACTOR MICROELECTRONICS CO., LTD, Xi'an (CN)

(72) Inventors: Shihong Yang, Xi'an (CN); Hu Wang, Xi'an (CN)

( * ) Notice: Subject to any disclaimer, the term of this patent is extended or adjusted under 35 U.S.C. 154(b) by 0 days.

(21) Appl. No.: 16/259,637

(22) Filed: Jan. 28, 2019

(65) Prior Publication Data

US 2019/0159305 A1 May 23, 2019

Related U.S. Application Data

(63) Continuation of application No. PCT/CN2017/084305, filed on May 15, 2017.

(30) Foreign Application Priority Data

Jan. 20, 2017 (CN) ..... 2017 1 0048486

(51) Int. Cl.

| | |
|---|---|
| ***H05B 45/00*** | (2020.01) |
| ***H05B 45/14*** | (2020.01) |
| ***H05B 45/37*** | (2020.01) |
| ***F21V 23/06*** | (2006.01) |
| ***F21S 4/10*** | (2016.01) |

(52) U.S. Cl.

CPC ..... *H05B 45/00* (2020.01); *F21S 4/10* (2016.01); *F21V 23/06* (2013.01); *H05B 45/37* (2020.01)

(58) Field of Classification Search

None

See application file for complete search history.

(56) References Cited

U.S. PATENT DOCUMENTS

2007/0024213 A1* 2/2007 Shteynberg ..... H05B 33/0815 315/291
2014/0232268 A1* 8/2014 Kamoi ..... H05B 33/089 315/117
2015/0208475 A1 1/2015 Xu et al.

FOREIGN PATENT DOCUMENTS

CN 202798489 U 3/2013
CN 104093257 A 10/2014
CN 104244493 A 12/2014
(Continued)

OTHER PUBLICATIONS

International Search Report of PCT/CN2017/084305, dated Nov. 1, 2017.

*Primary Examiner* — Dedei K Hammond
(74) *Attorney, Agent, or Firm* — W&K IP

(57) ABSTRACT

An LED driving circuit and a driving method thereof. The LED driving circuit comprises a rectifying circuit (40), a filter circuit (20), a current limiting circuit (10), a detection and control circuit (30), and an LED lamp string. The rectifying circuit is connected to an alternating-current power supply, and the negative electrode of the rectifying circuit is connected to the second end of the filter circuit and the second end of the detection and control circuit; the input end of the current limiting circuit is connected to the positive electrode of the rectifying circuit, the first output end of the current limiting circuit is connected to the positive electrode of the LED lamp string and the input end of the filter circuit, and the second output end of the current limiting circuit is connected to the third end of the detection and control circuit.

13 Claims, 12 Drawing Sheets

(56) References Cited

FOREIGN PATENT DOCUMENTS

| | | | |
|---|---|---|---|
| CN | 106163009 | A | 11/2016 |
| CN | 206380139 | U | 8/2017 |

* cited by examiner

LED DRIVING CIRCUIT AND DRIVING METHOD THEREOF

CROSS REFERENCE TO RELATED APPLICATIONS

This application is a continuation of International Patent Application No. PCT/CN2017/084305 with a filing date of May 15, 2017, designating the United States, now pending, and further claims priority to Chinese Patent Application No. 201710048486.X entitled "LED DRIVING CIRCUIT AND DRIVING METHOD THEREOF" filed on 2017 Jan. 20, the entire content of which is incorporated herein by reference.

TECHNICAL FIELD

The present disclosure relates to the field of LED driving, and particularly to an LED driving circuit and a driving method thereof.

BACKGROUND

At present, there are two common problems existing in a high-voltage linear integrated circuit (IC) on the market: 1. a voltage of a Light Emitting Diode (LED) loaded lamp bead is severely restricted by an input voltage, and a total voltage drop of the lamp bead cannot be too much lower than the input voltage. 2. LED illumination stroboflash is severe when the input voltage fluctuates.

In the prior art, a current flowing through an LED lamp string under the control of a control circuit be a constant value in the control of an LED power source, and the constant value does not change along with the change of the input voltage of an external circuit. The control circuit is as shown in FIG. 1. When the input voltage is greater than a set voltage, redundant voltage drop may be applied to the current control circuit IC, so that the temperature of the IC is increased, thereby increasing power consumption, and burning out the IC, when the input voltage is smaller than the set voltage, a charge voltage on a capacitor may be reduced Under the same condition, the discharge time of the capacitor is shortened and the stroboflash of the LED lamp string is severe.

A relationship of a voltage and a current on an output end of a rectifying circuit may be shown in FIG. 2. In FIG. 2, V1 refers to a waveform diagram of a voltage that is rectified and filtered, and I3 refers to a waveform diagram of a current of an LED lamp string. Since the voltage drop on the LED lamp string is a constant value, a voltage waveform V3 of an input end of a current control circuit 50 as shown in FIG. 2 is consistent with the waveform V1.

Generally, a filter circuit 20 may include an electrolytic capacitor C, and thus a magnitude of the voltage V1 is related to the following factors: a magnitude of an input voltage of a power source, a magnitude of an electrolytic capacitor C, and a magnitude of a circuit charge/discharge current.

At a moment t11, a positive voltage V1 of an LED lamp string exceeds a voltage required for conducting the LED lamp string. When the LED lamp string is conducted, the charge current in the filter circuit 20 is the largest, and may be reduced along with the increase of the voltage. A current I3 flowing through the LED lamp string under the control of the current control circuit 50 may be a constant value, and the voltage drop on both ends of the LED lamp string is equal to V11, at a moment t2, the input voltage of the power source reaches a maximum value, the voltage on the filter circuit 20 also reaches a maximum value, the charging of the capacitor in the filter circuit 20 is stopped, and the voltage V3 on the input end of the current control circuit 50 also reaches a maximum value; then, the input voltage is gradually reduced, the capacitor in the filter circuit 20 begins discharging, a sum of a discharge current of the capacitor and a current flowing in from the power source is equal to the current in the LED lamp string to maintain the LED lamp string conducted, and the voltage V3 on the input end of the current control circuit 50 is also reduced accordingly, at a moment t3, the voltage of the power source is lower than the voltage of the filter circuit 20, the power source stops inputting the current, the filter circuit 20 discharges to maintain the LED lamp string conducted, and the voltage of the filter circuit 20 drops; at a moment t31, the voltage V1 of the filter circuit 20 is equal to the conduction voltage V11 of the LED lamp string, and the current in the LED lamp string is reduced along with the decrease of the voltage V1; at a moment t5, the voltage V1 is reduced to a minimum value, the current in the LED lamp string is the smallest, and then the voltage V1 is increased with the increase of the input voltage, and the current in the LED lamp string is also increased; at a moment t51, the voltage V1 reaches the conduction voltage of the LED lamp string again, and the above process is repeated.

At the moments t1 to t3, the voltage V1 changes according to a sine rule, at the moments t3 to t5, the voltage V1 drops according to an exponential curve, and the constant of the discharge time is related to the magnitude of the capacitor, the magnitude of the discharge current, and the like; at the moments t3 to t5, the capacitor in the filter circuit 20 discharges, the magnitude of the discharge current is controlled by the current control circuit 50, and the voltage V1 is reduced.

When the input voltage of the power source is smaller than a nominal voltage, energy stored in the filter circuit 20 may be insufficient to discharge to maintain the input voltage reaching the voltage required for conduction again, which may worsen the stroboflash of the LED lamp string.

When the input voltage is greater than the nominal voltage, the voltages V1 of the filter circuit 20 and a positive end of the LED lamp string are increased. During the charge and discharge of the filter circuit 20, the next charge begins before the previous discharge is finished, so that the voltage on the filter circuit is increased, the voltages V1 are entirely moved up, and are always greater than the conduction voltage of the LED lamp string during a full period, and the current in the LED lamp string is a constant value. The LED lamp string has no stroboflash at this time, as shown by a waveform V12 in FIG. 3. However, a negative voltage V3 of the LED lamp string is also increased, as shown by a waveform V32. That is, since the voltage drop on the current control circuit 50 is increased, the power consumption is increased, and heat is also increased, thereby resulting in sharp increase of temperature and reduction of reliability. In the drawing, V11 refers to a waveform diagram of a positive voltage of the LED lamp string when an input voltage is equal to a nominal voltage, and V31 refers to a waveform diagram of a negative voltage of the LED lamp string.

SUMMARY

To overcome defects existing in the prior art, the present disclosure provides an LED driving circuit, including a rectifying circuit, a filter circuit, a current-limiting circuit, a detection and control circuit and an LED lamp string; the rectifying circuit is connected with an alternating-current power source, and a negative pole of the rectifying circuit is connected with a second end of the filter circuit and a second end of the detection and control circuit respectively; an input end of the current-limiting circuit is connected with a positive pole of the rectifying circuit, a first output end of the current-limiting circuit is connected with a positive pole of the LED lamp string and an input end of the filter circuit respectively, and a second output end of the current-limiting circuit is connected with a third end of the detection and control circuit; a negative pole of the LED lamp string is connected with an input end of the detection and control circuit.

The detection and control circuit may include a control circuit and a voltage-dividing circuit, where the voltage-dividing circuit may include voltage-dividing resistors R1 and R2 which are connected in series.

The second output end of the current-limiting circuit is connected with the third end of the control circuit, and the negative pole of the LED lamp string is connected with the input end of the control circuit and an input end of the resistor R1 respectively; the resistors R1 and R2 are connected in series, and a fourth end of the control circuit is connected with an output end of the resistor R1 and an input end of the resistor R2 respectively, the negative pole of the rectifying circuit is connected with the second end of the control circuit and an output end of the resistor R2 respectively.

A filter capacitor C1 may be added on the fourth end of the control circuit, where the capacitor C1 is connected in parallel with the resistor R2.

The current-limiting circuit may be used to control the charge current of the filter circuit and a current I3 of the LED lamp string.

The detection and control circuit may be used to detect the current in the LED lamp string and control the current-limiting circuit and the filter current according to a detection result.

The detection and control circuit may detect a voltage V3 at the negative pole of the LED lamp string, where the voltage V3 is referred to as a first detection voltage.

When the first detection voltage V3 is smaller than a third set voltage V33, a first output current I2 flowing out of the first output end of the current-limiting circuit is a first constant current I21, the first constant current I21 supplies a charge current of the filter circuit and the current I3 of the LED lamp string, the current I3 flowing through the LED lamp string is controlled by the detection and control circuit, no current is output from the second output end of the current-limiting circuit, and a second output current I5 is zero.

When the first detection voltage V3 is greater than or equal to the third set voltage V33 and smaller than a fourth set voltage V34, the first output current I2 of the current-limiting circuit is reduced along with the increase of the first detection voltage V3, and the second output current I5 flowing from the current-limiting circuit to the detection and control circuit is increased along with the increase of the first detection voltage V3 at the same time.

When the first detection voltage V3 is greater than or equal to the fourth set voltage V34, the first output current I2 of the current-limiting circuit remains as a second constant current I22, and the second output current I5 of the current-limiting circuit remains as a third constant current I51, at this time, the second constant current I22 is a minimum current flowing from the current-limiting circuit to the LED lamp string and the filter circuit, and the third constant current I51 is a maximum current flowing from the current-limiting circuit to the detection and control circuit.

The present disclosure also provides a driving method of an LED driving circuit, by which the detection and control circuit detects a first detection voltage V3 at the negative pole of the LED lamp string and controls a magnitude of a current I3 flowing through the LED lamp string according to a magnitude of the first detection voltage V3.

When the first detection voltage V3 is smaller than a first set voltage V31, no current flows through the LED lamp string, and a first output current I2 of the current-limiting circuit is a first constant current I21 used for charging a capacitor in the filter circuit. At this time, a charge current I4 of the filter circuit is the largest, and a second output current I5 of the current-limiting circuit is zero.

When the first detection voltage V3 is equal to the first set voltage V31, the LED lamp string is conducted and there is a current flowing through the LED lamp string. At this time, the first output current I2 flowing out of the current-limiting circuit remains as the first constant current I21, where the first constant current I21 may be divided into two parts, one part of which is used for charging the filter circuit, and the other part flows through the LED lamp string for turning on the LED lamp string, and the second output current I5 of the current limiting circuit continues to be zero.

When the first detection voltage V3 is greater than the first set voltage V31 and smaller than a second set voltage V32, the first output current I2 flowing out of the current-limiting circuit continues to remain as the first constant current I21 With the increase of the first detection voltage V3, the current I3 flowing through the LED lamp string is increased and the charge current I4 of the filter circuit is reduced, and the second output current I5 of the current-limiting circuit continues to be zero.

When the first detection voltage V3 is greater than or equal to the second set voltage V32 and smaller than a third set voltage V33, the first output current I2 flowing out of the current-limiting circuit is the first constant current I21, the current I3 flowing through the LED lamp string under the control of the detection and control circuit may be a fourth constant current I32. At this time, the fluctuation of the first detection voltage V3 may not cause the fluctuation of the current I3, and the second output current I5 of the current-limiting circuit continues to be zero.

When the first detection voltage V3 is greater than or equal to the third set voltage V33 and smaller than a fourth set voltage V34, the first output current I2 flowing out of the current-limiting circuit is reduced along with the increase of the first detection voltage V3; at the same time, the detection and control circuit draws the second output current I5 from the current-limiting circuit, the second output current I5 flowing from the current-limiting circuit to the detection and control circuit is increased with the increase of the first detection voltage V3, the current I3 flowing through the LED lamp string under the control of the detection and control circuit remains as the fourth constant current I32, and the second output current I5 is far smaller than the first output current I2.

When the first detection voltage V3 is greater than or equal to the fourth set voltage V34, the first output current I2 flowing out of the current-limiting circuit remains as a second constant current I22, and the second output current I5 flowing out of the current-limiting circuit remains as a third constant current I51; at this time, the second constant current I22 is a minimum current flowing from the current-limiting circuit to the LED lamp string and the filter circuit, the third constant current I51 is a maximum current flowing from the current-limiting circuit to the detection and control circuit, and the third constant current I51 is far smaller than the second constant current I22.

A second detection voltage V4 may be obtained by performing voltage division for the first detection voltage V3, and the second detection voltage V4 may have corresponding smaller voltage fluctuation, so that the first output current I2 of the current-limiting circuit has corresponding smaller fluctuation. In this way, the current I3 on the LED lamp string and the voltage drop on the detection and control circuit are relatively stable. Further, different voltage division ratios may be correspondingly adapted to different input voltages.

A constant second detection voltage V4 may be obtained by filtering the second detection voltage V4, so that the first output current I2 of the current-limiting circuit is also a constant value correspondingly, thereby ensuring that the current I3 on the LED lamp string is constant and the voltage drop on the detection and control circuit is stable.

The current-limiting circuit may include a second power supply circuit, a control and driving circuit, a second driving circuit, a second current-sampling circuit and a power tube Q2, where the second driving circuit is connected to the second power supply circuit, the control and driving circuit, the second current-sampling circuit and a control end of the power tube Q2, and the second power supply circuit is connected to the control and driving circuit.

The control circuit may include a first power supply circuit, a reference circuit, a first driving circuit, a first current-sampling circuit, a voltage-sampling circuit, a pull-down current circuit and a power tube Q1, where the reference circuit is connected to the first power supply circuit and the first driving circuit, the first driving circuit is connected to a control end of the power tube Q1 and the first current-sampling circuit, and the voltage-sampling circuit is connected to the pull-down current circuit and the first current-sampling circuit.

The current-limiting circuit may be provided with a second over-temperature protection circuit connected with the second driving circuit.

The control circuit may be provided with a first over-temperature protection circuit connected with the first driving circuit.

According to the present disclosure, the problems that the power consumption is increased and the burnout of the current control circuit may be caused when the voltage of the power source is increased in the prior art may be solved. Also, the problem of worsening stroboflash of the LED lamp string when the voltage of the power source is reduced may be solved.

BRIEF DESCRIPTION OF DRAWINGS

FIG. 8(*b*) is another waveform diagram illustrating an output voltage V2 and a first output current I2 of a current-limiting circuit in a high input voltage range according to an example of the present disclosure.

DETAILED DESCRIPTION

The present disclosure will be further described below in detail in combination with FIGS. 1-17.

Figure 1:
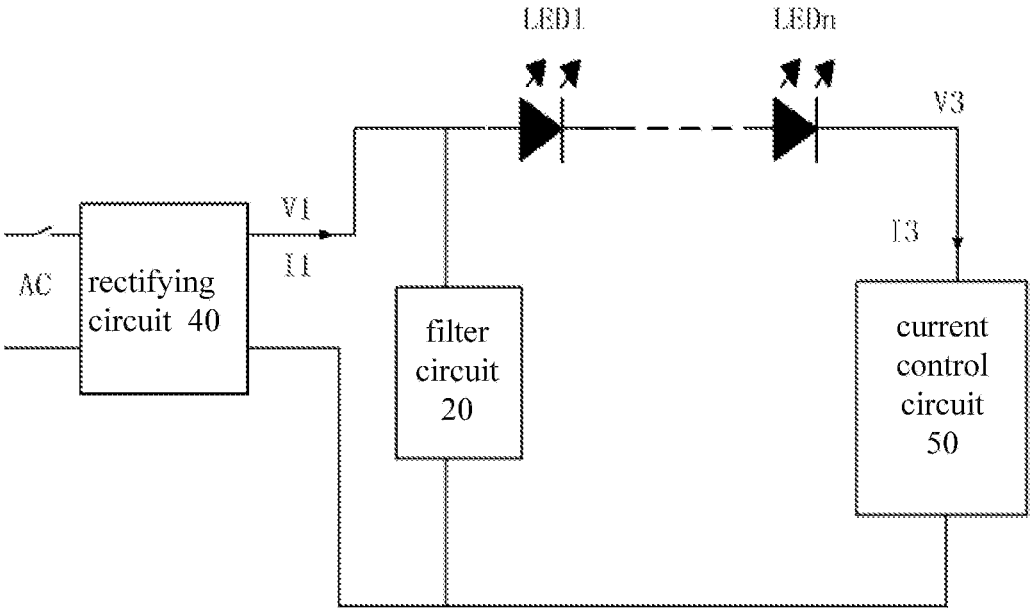
FIG. 1 is a schematic diagram illustrating an LED control circuit in the prior art.
Figure 2:
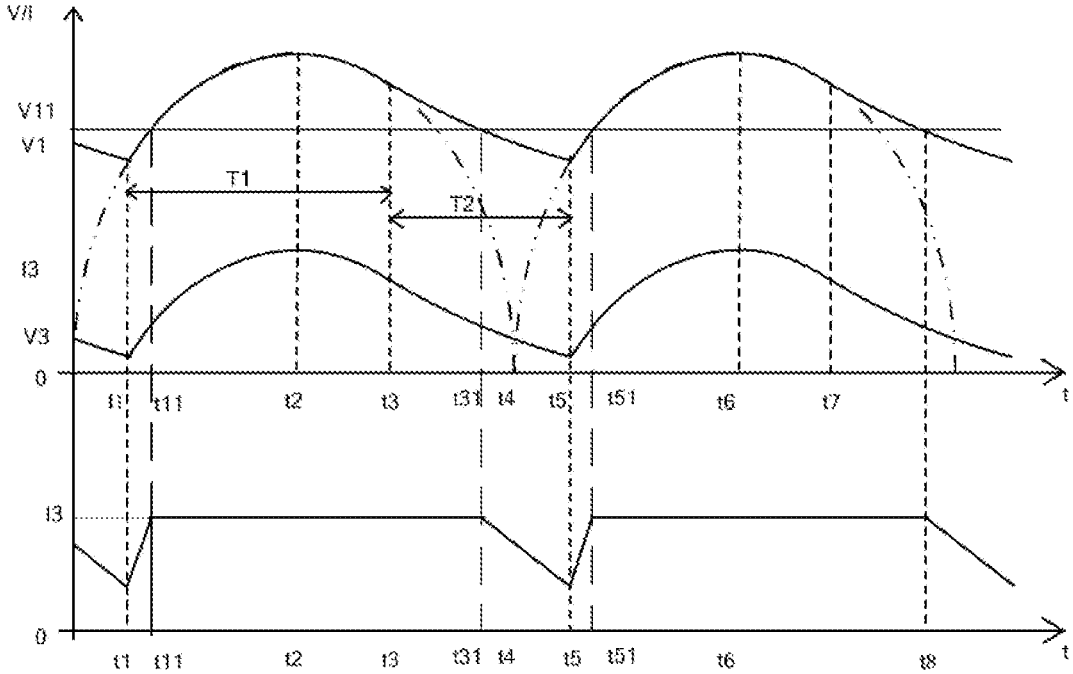
FIG. 2 is a schematic diagram illustrating a relationship of a voltage and a current on an output end of a rectifying circuit in an LED control circuit in the prior art.
Figure 3:
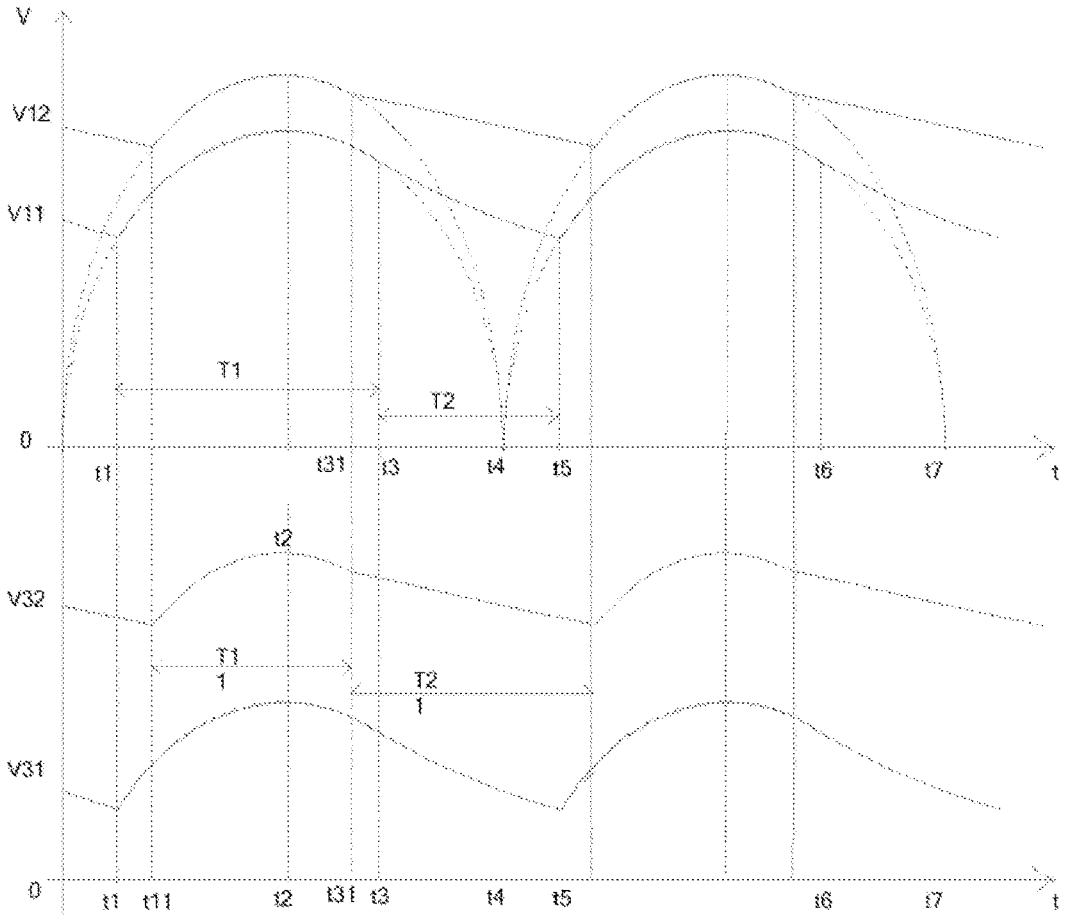
FIG. 3 is a schematic diagram illustrating a relationship of a voltage and a current of a rectifying circuit at different input voltages in an LED control circuit in the prior art.
Figure 4:
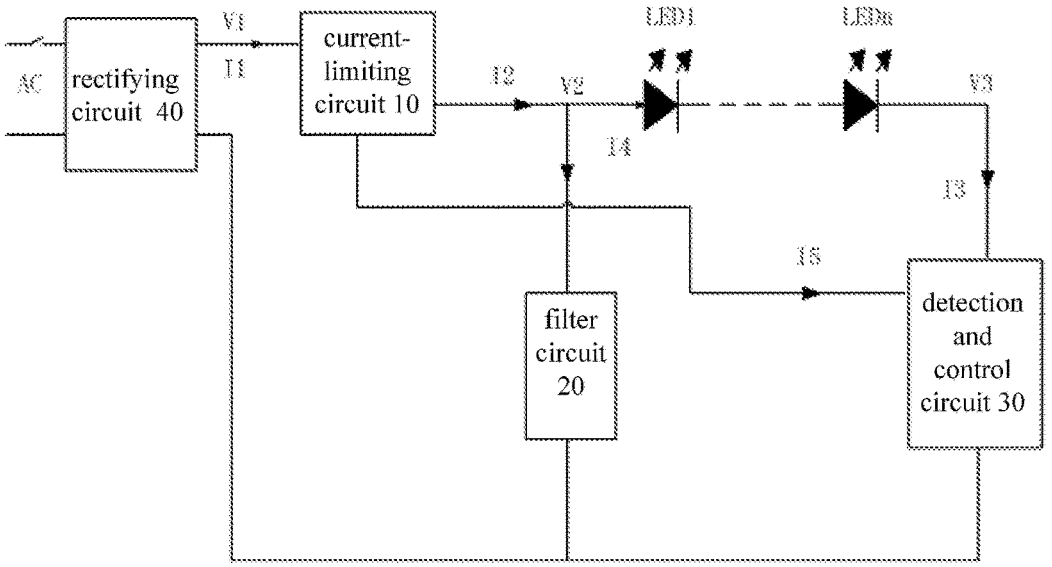
FIG. 4 is a schematic diagram illustrating an LED driving circuit according to an example of the present disclosure.

FIG. 4 is a schematic diagram illustrating an LED driving circuit according to an example of the present disclosure. The LED driving circuit may include a rectifying circuit 40, a filter circuit 20, a current-limiting circuit 10, a detection and control circuit 30 and an LED lamp string.

The rectifying circuit 40 is connected with an alternating-current power source for converting an alternating-current voltage into a direct-current voltage; a negative pole of the rectifying circuit 40 is connected to a second end of the filter circuit 20 and a second end of the detection and control circuit 30.

An input end of the current-limiting circuit 10 is connected with a positive pole of the rectifying circuit 40, a first output end of the current-limiting circuit 10 is connected with a positive pole of an LED lamp string and an input end of the filter circuit 20, and a second output end of the current-limiting circuit 10 is connected with a third end of the detection and control circuit 30. The current limiting circuit 10 is used to control the quantity of energy charged into an electrolytic capacitor in the filter circuit 20, that is, to control a charge current of the filter circuit 20 and a current I3 in the LED lamp string; the detection and control circuit 30 is used to detect the magnitude of a voltage in the negative pole of the LED lamp string and feed the voltage back to the current-limiting circuit 10, and control the magnitude of the current I3 flowing through the LED lamp string.

The input end of the filter circuit 20 is connected with the first output end of the current-limiting circuit 10, and the filter circuit 20 is used to reduce a ripple in the direct-current voltage.

The negative pole of the LED lamp string is connected with the input end of the detection and control circuit 30. Since the voltage drop on the LED lamp string is fixed, the voltage on the input end of the detection and control circuit 30 may change with the change of the voltages V2 in the filter circuit 20 and the positive pole of the LED lamp string, and the waveform of the voltage V3 on the input end of the detection and control circuit 30 is consistent with the waveforms of the voltages V2 in the filter circuit 20 and the positive pole of the LED lamp string.

The third end of the detection and control circuit 30 is connected with the second output end of the current-limiting circuit 10. The detection and control circuit 30 is used to detect the current in the LED lamp string and control the current-limiting circuit 10 and the filter circuit 20 according to a detection result.

Figure 5:
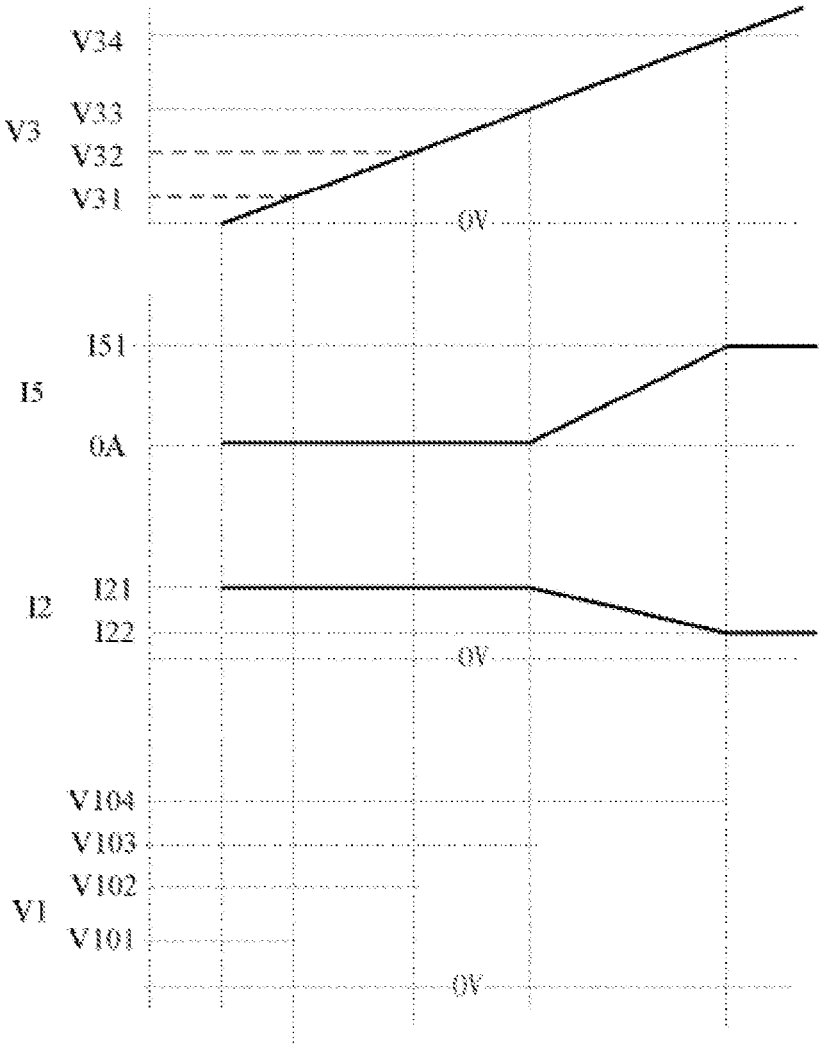
FIG. 5 is a schematic diagram illustrating a working principle of a current-limiting circuit of an LED control circuit according to an example of the present disclosure.

As shown in FIG. 5, a working principle of the current-limiting circuit 10 of an LED driving circuit according to an example of the present disclosure is described below.

The waveform of the voltage V3 in the negative pole of the LED lamp string is same as the waveform of the voltage V2 in the positive pole of the LED lamp string, the detection and control circuit 30 detects the voltage V3 in the negative pole of the LED lamp string, and the voltage V3 is referred to as a first detection voltage. The current-limiting circuit 10 may work under the following circumstances.

1. When the first detection voltage V3 is smaller than a third set voltage V33, a first output current I2 flowing out of the first output end of the current-limiting circuit 10 is a first constant current I21, the first constant current I21 supplies a charge current of the filter circuit 20 and a current I3 of the LED lamp string, the current I3 flowing through the LED lamp string is controlled by the detection and control circuit 30, no current is output from the second output end of the current-limiting circuit 10, and a second output current I5 is zero.

2. When the first detection voltage V3 is greater than or equal to the third set voltage V33 and smaller than a fourth set voltage V34, the first output current I2 of the current-limiting circuit 10 is reduced with the increase of the first detection voltage V3; at the same time, the second output current I5 flowing from the current-limiting circuit 10 to the detection and control circuit 30 is increased with the increase of the first detection voltage V3.

3. When the first detection voltage V3 is greater than or equal to the fourth set voltage V34, the first output current I2 of the current-limiting circuit 10 remains as a second constant current I22, and the second output current I5 of the current-limiting circuit 10 remains as a third constant current I51, at this time, the second constant current I22 is a minimum current flowing from the current-limiting circuit 10 to the LED lamp string and the filter circuit 20, and the third constant current I51 is a maximum current flowing from the current-limiting circuit to the detection and control circuit 30.

The magnitude of the second output current I5 is far smaller than the magnitude of the first output current I2.

Figure 6:
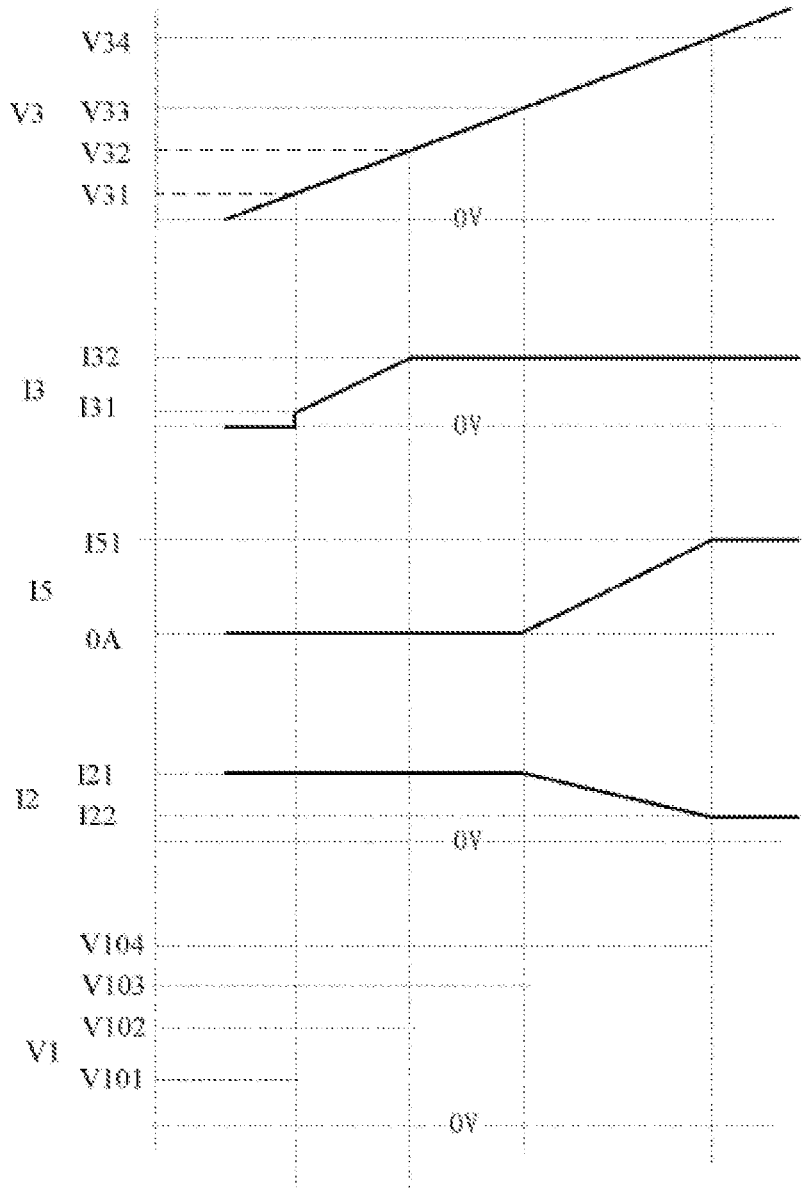
FIG. 6 is a schematic diagram illustrating a control situation of a detection and control circuit and a current-limiting circuit of an LED control circuit according to an example of the present disclosure.

As shown in FIG. 6, a control situation of the detection and control circuit 30 of an LED driving circuit according to an example of the present disclosure is described below.

The detection and control circuit 30 detects the first detection voltage V3 in the negative pole of the LED lamp string and controls the magnitude of the current I3 flowing through the LED lamp string according to a magnitude of the first detection voltage V3.

1. When the first detection voltage V3 is smaller than a first set voltage value V31, no current flows through the LED lamp string, and the first output current I2 of the current-limiting circuit 10 is the first constant current I21 used for charging a capacitor in the filter circuit 20; at this time, the charge current I4 of the filter circuit 20 is the largest, and the second output current I5 of the current-limiting circuit 10 is zero.

2. When the first detection voltage V3 is equal to the first set voltage V31, the LED lamp string is conducted and there is a current flowing through the LED lamp string; at this time, the first output current I2 flowing out of the current-limiting circuit 10 remains as the first constant current I21, where the first constant current I21 is divided into two parts, one part of which is used for charging the filter circuit 20, the other part flows through the LED lamp string for turning on the LED lamp string, and the second output current I5 of the current-limiting circuit 10 continues to be zero.

3. When the first detection voltage V3 is greater than the first set voltage V31 and smaller than a second set voltage V32, the first output current I2 flowing out of the current-limiting circuit 10 continues to remain as the first constant current I21. With the increase of the first detection voltage V3, the current I3 flowing through the LED lamp string is increased, the charge current I4 of the filter circuit 20 is reduced, and the second output current I5 of the current-limiting circuit 10 continues to be zero.

4 When the first detection voltage V3 is greater than or equal to the second set voltage V32 and smaller than the third set voltage V33, the first output current I2 flowing out of the current-limiting circuit 10 is the first constant current I21, and the current I3 flowing through the LED lamp string under the control of the detection and control circuit 30 may be a fourth constant current I32; at this time, the fluctuation of the first detection voltage V3 may not cause the fluctuation of the current I3, and the second output current I5 of the current-limiting circuit 10 continues to be zero.

5. When the first detection voltage V3 is greater than or equal to the third set voltage V33 and smaller than a fourth set voltage V34, the first output current I2 flowing out of the current-limiting circuit 10 is reduced with the increase of the first detection voltage V3, at the same time, the detection and control circuit 10 draws the second output current I5 from the current-limiting circuit 10, the second output current I5 flowing from the current-limiting circuit 10 to the detection and control circuit 30 is increased with the increase of the first detection voltage V3, the current I3 flowing through the LED lamp string under the control of the detection and control circuit 30 remains as the fourth constant current I32, and the second output current I5 is far smaller than the first output current I2.

6. When the first detection voltage V3 is greater than or equal to the fourth set voltage V34, the first output current I2 flowing out of the current-limiting circuit 10 remains as the second constant current I22, and the second output current I5 flowing out of the current-limiting circuit remains as the third constant current I51, at this time, the second constant current I22 is a minimum current flowing from the current-limiting circuit to the LED lamp string and the filter circuit 20, the third constant current I51 is a maximum current flowing from the current-limiting circuit to the detection and control circuit 30, and the third constant current I51 is far smaller than the second constant current I22.

7. When the fluctuation of the first detection voltage V3 is small, the fluctuation of the output current of the current-limiting circuit 10 is also reduced; when the first detection voltage V3 is a constant value, the first output current I2 of the current-limiting circuit 10 is also a constant value correspondingly, thereby ensuring that the current I3 on the LED lamp string is constant and the voltage drop on the detection and control circuit 30 is stable.

8. The first set voltage V31 to the fourth set voltage V34 of the first detection voltage V3 may correspond to a first threshold voltage V101 to a fourth threshold voltage V104 of the output voltage of the rectifying circuit 40 respectively.

Figure 7:
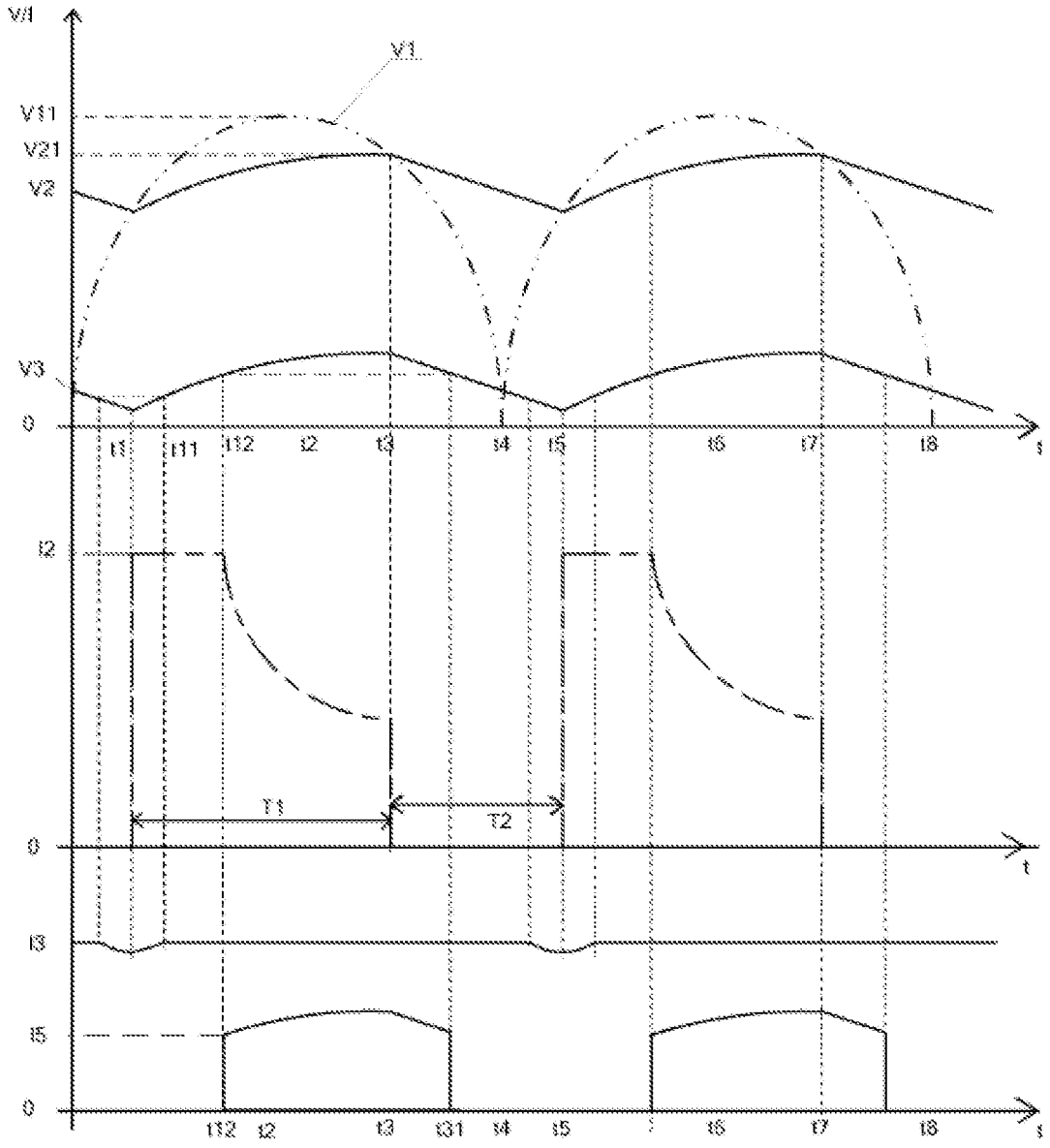
FIG. 7 is a waveform diagram illustrating an output voltage V2 and a first output current I2 of a current-limiting circuit in a low input voltage range according to an example of the present disclosure.
Figure 8A:
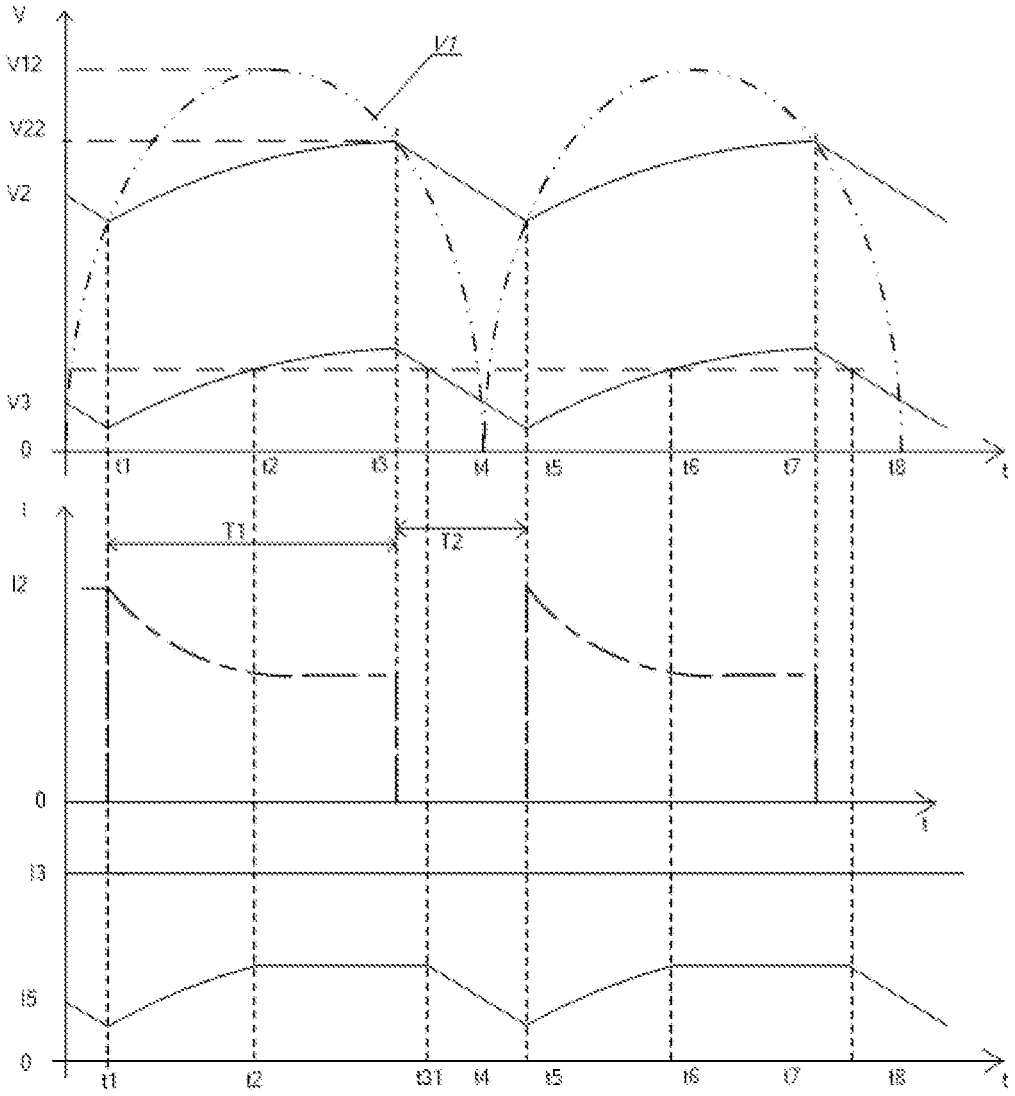
FIG. 8(*a*) is a waveform diagram illustrating an output voltage V2 and a first output current I2 of a current-limiting circuit in a high input voltage range according to an example of the present disclosure.
Figure 8B:
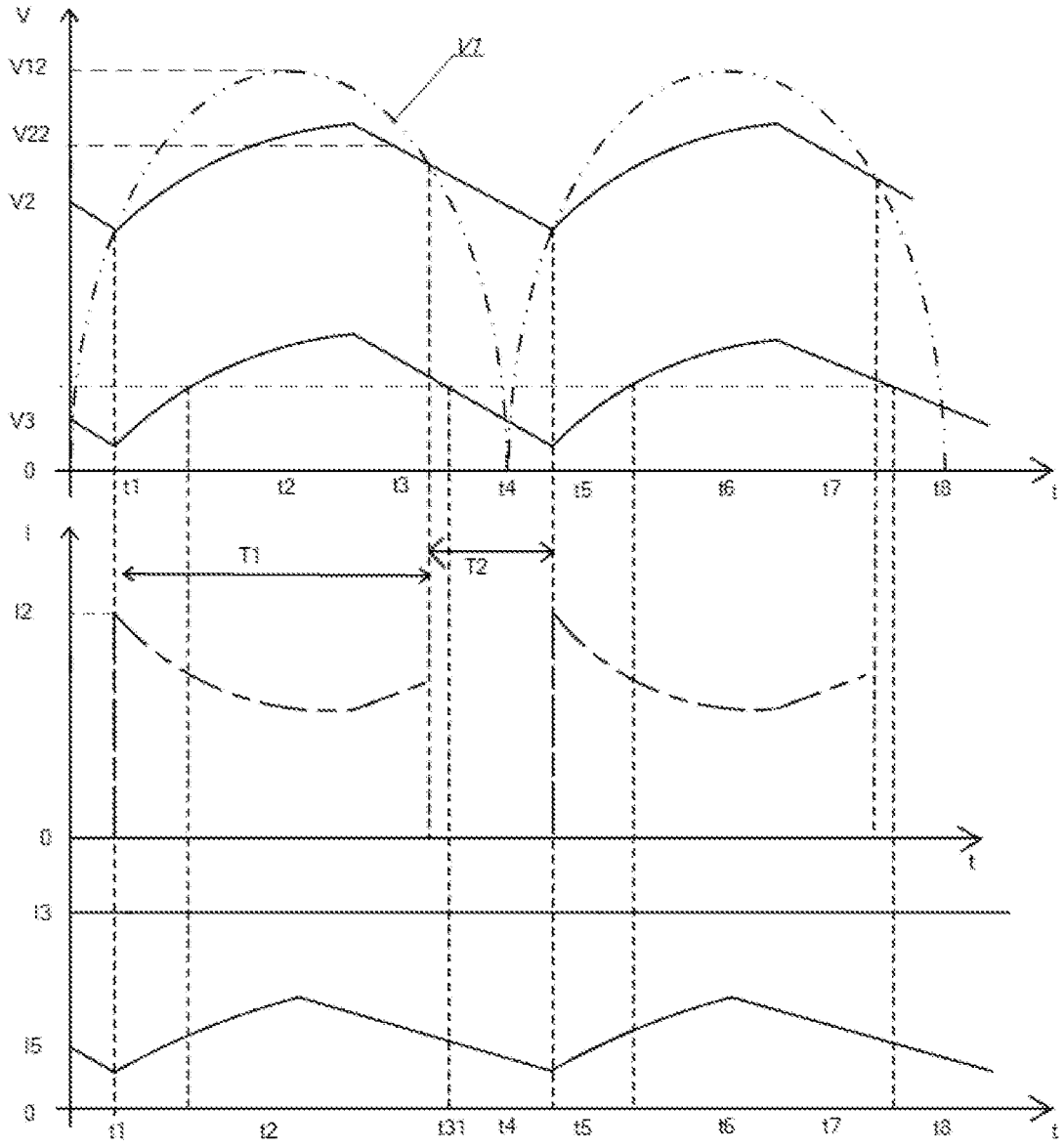

Waveform diagrams of output voltage V2 and a first output current I2 of a current-limiting circuit 10 of an LED driving circuit at different input voltages according to an example of the present disclosure are shown in FIG. 7, FIG. 8(*a*) and FIG. 8(*b*).

I. When an input voltage range is between a first threshold V101 and a third threshold V103, as shown in FIG. 7, the maximum value of the input voltage is V11 at this time. After passing through the rectifying circuit 40, as shown in FIG. 7, V1 refers to a voltage on the input end of the current-limiting circuit 10, V2 refers to a voltage on the output end of the current-limiting circuit 10, I2 refers to a first output current of the current-limiting circuit 10, V3 refers to a first detection voltage on an input end of the detection and control circuit 30, I3 refers to a current on the input end of the detection and control circuit 30, and I5 refers to a second output current of the current-limiting circuit 10; since the second output current I5 is far smaller than the first output current I2, the currents shown in the same drawing, are not in a same scale and used only for convenience of understanding.

At a moment t1, the voltage on both ends of the LED lamp string is greater than a conduction voltage of the LED lamp string. When the LED lamp string is conducted, the first detection voltage V3 is a minimum value and smaller than the second set voltage value V32, the current I3 flowing into the LED lamp string is also the minimum value, but the first output current I2 of the current-limiting circuit 10 is a maximum value.

With the increase of the first detection voltage V3, the current I3 is also increased correspondingly, the first output current I2 remains constant; at a moment t11, the first detection voltage V3 is equal to the second set voltage value V32, the current I3 is equal to the fourth constant current I32, and the first output current I2 is equal to the first constant current I21, in this phase, the second output current I5 does not flow from the current-limiting circuit 10 to the detection and control circuit 30.

At a moment t12, the first detection voltage V3 is equal to the third set voltage V33, the first detection voltage V3 then continues to increase, the first output current I2 begins to decrease, and the second output current I5 flowing from the current limiting circuit 10 to the detection and control circuit 30 is increased with the increase of the first detection voltage V3.

At a moment t3, the voltage V2 on the output end of the current-limiting circuit 10 is equal to a rectified input voltage V21 of a power source, a capacitor in the filter circuit 20 begins discharging, the first output current I2 of the current-limiting circuit 10 is zero, the magnitude of the current discharged by the capacitor is controlled by the detection and control circuit 30 and is a constant value, the voltage V2 is linearly reduced, the first detection voltage V3 is also linearly reduced, and the second output current I5 is correspondingly reduced. At a moment t31, the first detection voltage V3 is reduced to be equal to the third set voltage V33, at this time, the second output current I5 is zero. At a moment close to t5, the voltage V2 on the filter circuit 20 is reduced to be close to the minimum value, the first detection voltage V3 is smaller than the second set voltage value V32, and the current I3 begins to decrease from the constant value. At the moment t5, the first detection voltage V3 is a minimum value, the current I3 is also a minimum value, but the current I2 flowing from the first output end of the current-limiting circuit 10 is a maximum value.

The above process may be repeated with the increase of time.

II, when the range of the input voltage of the power source is greater than the third threshold V103, as shown in FIG. 8(*a*) and FIG. 8(*b*), after passing through the rectifying circuit, V1 refers to a voltage on the input end of the current-limiting circuit 10, V2 refers to a voltage on the output end of the current-limiting circuit 10, I2 refers to the first output current of the current-limiting circuit 10, V3 refers to the first detection voltage on the input end of the detection and control circuit 30, I3 refers to the current on the input end of the detection and control circuit 30, and I5 refers to the second output current of the current-limiting circuit 10. Since the second output current I5 is far smaller than the first output current I2, the currents shown in the same drawing are not in the same scale and used only for convenience of understanding.

At a moment t1, the voltage on both ends of the LED lamp string is greater than the conduction voltage of the LED lamp string and the LED lamp string is conducted. At this time, the first detection voltage V3 is a minimum value, which is greater than the third set voltage value V33 and smaller than the fourth set voltage V34, the current I3 flowing into the LED lamp string is the fourth constant current I32, the first output current I2 of the current-limiting circuit 10 is a maximum value, and the second output current I5 of the current-limiting circuit 10 is a minimum value. With the increase of the first detection voltage V3, the current I3 remains constant, the current I2 is gradually reduced, and the second output current I5 of the current-limiting circuit 10 is correspondingly increased.

At a moment t2, the first detection voltage V3 is equal to the fourth set voltage V34, the current I3 remains constant, the first output current I2 is the second constant current I22, and the second output current I5 is the third constant current I51. Then, the voltage V3 is increased, but the current I3, the first output current I2 and the second output current I5 all remain constant.

At a moment t3, the first detection voltage V3 is same as the voltage passing through the rectifying circuit, the first output current I2 of the current-limiting circuit 10 is zero, the filter circuit 20 stops charging and turns to supply the current I3 for the LED lamp string. Since the discharge current is a constant value, the voltage on the filter circuit 20 is linearly reduced, the voltage V3 is also linearly reduced. At a moment t31, the first detection voltage V3 is smaller than the fourth set voltage V34, the current I3 remains constant, and the second output current I5 is reduced with the decrease of the first detection voltage V3, at the moment T5, the voltage V3 and the second output current I5 reach the minimum value.

Then, the above process may be repeated.

Figure 9:
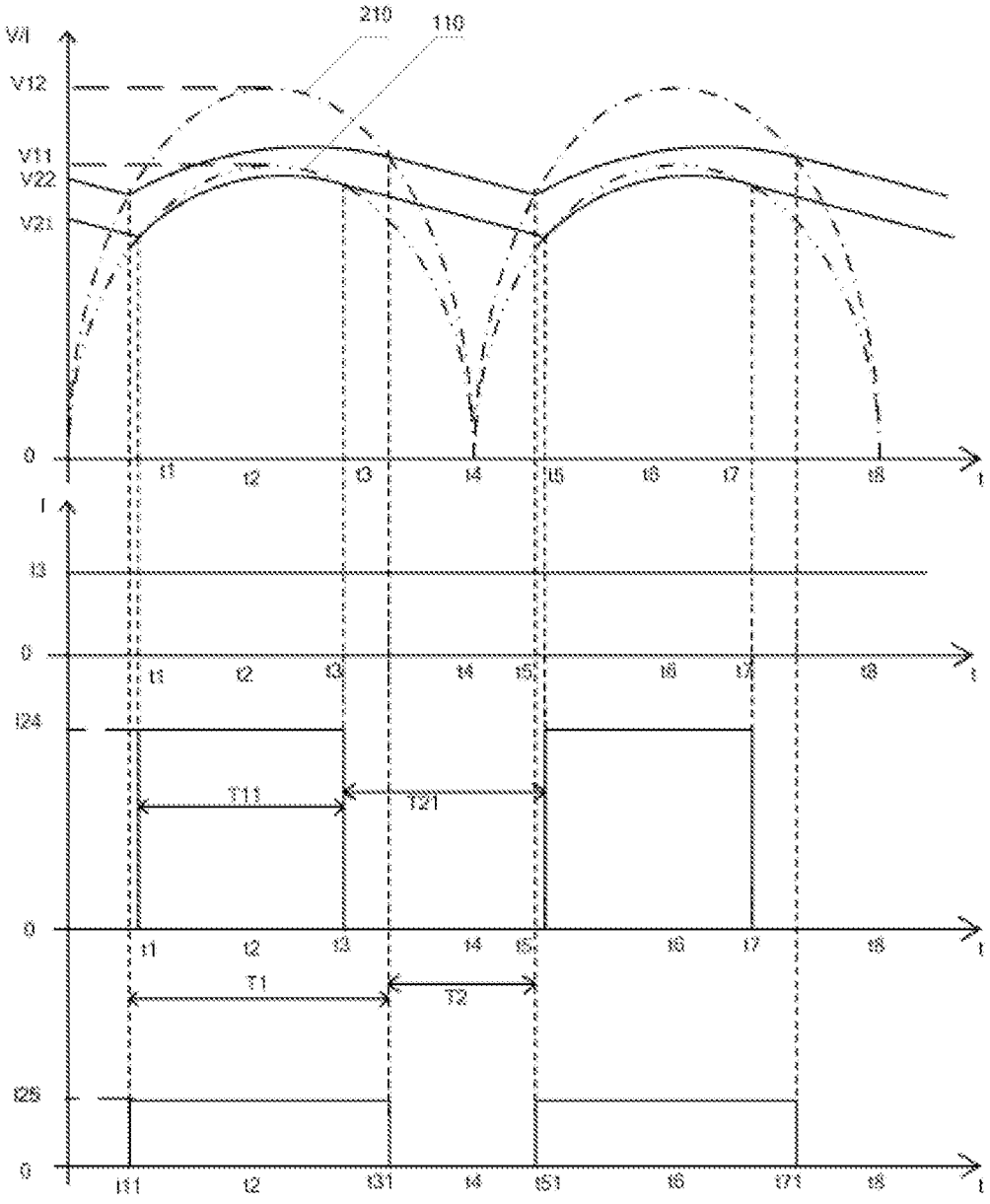
FIG. 9 is a schematic diagram illustrating drawing waveform diagrams at different input voltages together according to an example of the present disclosure.

III, the waveform diagrams at different input voltages are drawn in a same drawing. As shown in FIG. 9, it is assumed that the detection voltage V3 is between the voltage V33 and the voltage V34 at this time.

As can be seen from FIG. 9, time T11 when the current-limiting circuit 10 supplies the first output current I2 in the case that the input voltage of the power source is low (the highest voltage is V11) is smaller than time T1 when the current-limiting circuit 10 supplies the first output current I2 in the case that the input voltage of the power source is high (the highest voltage is V12) (the charging process is started again before the previous discharge is finished when the input voltage is high). That is, the charging time of the filter circuit 20 when the input voltage of the power source is low is smaller than the charging time of the filter circuit 20 when the input voltage of the power source is high, but discharging time T21 of the filter circuit 20 when the input voltage of the power source is low is greater than discharging time T2 of the filter circuit 20 when the input voltage of the power source is high. To maintain the voltage on the filter circuit basically unchanged when the input voltage of the power source changes and maintain the current on the LED lamp string constant, it is desired to reduce the input current when the input voltage of the power source is increased, so that the energy stored in the electrolytic capacitor in the filter circuit at different input voltages is same in each period, and the current-limiting circuit 10 controls the first output current by phases according to the different input voltages of the power source, thereby increasing an efficiency of the power source.

Meanwhile, when the input voltage of the power source is low, the electric energy stored in a filter capacitor in the filter circuit 20 is required to ensure that the current on the LED lamp string is uninterrupted during discharge, that is, the LED lamp string has no stroboflash During the discharge, the detection and control circuit 30 controls the current on the LED lamp string to decrease so as to prolong the discharging time of the filter capacitor.

Due to the existence of the current-limiting circuit 10, the voltage V22 on the filter circuit 20 when the input voltage of the power source is high does not change much compared with the voltage V21 on the filter circuit 20 when the input voltage of the power source is low.

When the range of the input voltage of the power source is between the third threshold V103 and the fourth threshold V104, the first output current I2 of the current-limiting circuit 10 is a constant value and does not fluctuate with the fluctuation of the input voltage. However, with the increase of the input voltage of the power source, the first output current I2 of the current-limiting circuit 10 is reduced with the increase of the input voltage of the power source. When the input voltage of the power source is as shown by 110 in the drawing (the maximum value is V11), the first output current I2 is as shown by a waveform I24. When the input voltage of the power source is as shown by 210 in the drawing (the maximum value is V12), the first output current I2 is as shown by a waveform I25. It can be seen that the first output current I2 is correspondingly reduced when the input voltage of the power source is increased, but the current I3 in, the LED lamp string remains as a constant value.

Figure 10:
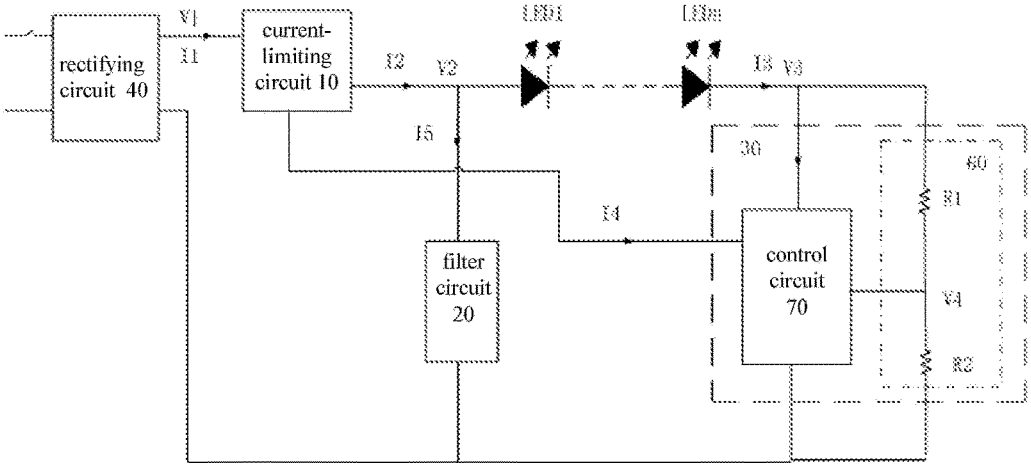
FIG. 10 illustrates an LED driving circuit according to a preferred example of the present disclosure.

IV, specifically, FIG. 10 illustrates an LED driving circuit according to a preferred example of the present disclosure. As shown in FIG. 10, the detection and control circuit 30 may include a control circuit 70 and a voltage-dividing circuit 60. The voltage-dividing circuit 60 may include voltage-dividing resistors R1 and R2 which are connected in series. The second output end of the current-limiting circuit 10 is connected with a third end of the control circuit 70, and the negative pole of the LED lamp string is connected with an input end of the control circuit 70 and an input end of the resistor R1 The resistor R1 is connected in series with the resistor R2, and a fourth end of the control circuit 70 is connected with an output end of the resistor R1 and an input end of the resistor R2 The negative pole of the rectifying circuit 40 is connected with a second end of the control circuit 70 and an output end of the resistor R2.

The numerical value of the second detection voltage V4 may be changed by setting a numerical value of a voltage-dividing resistor in the voltage-dividing circuit, thereby changing a detectable range of the input voltage. In this way, the circuit can be adapted to different ranges of the input voltage of the power source. A voltage value of the voltage-dividing voltage V4 (the second detection voltage) may be detected by performing voltage division for the first detection voltage V3, and the range of the voltage value of the second detection voltage may be changed by adjusting a resistance value of the resistor R1/R2, thereby adapting the circuit to different changes of the input voltage.

Figure 11:
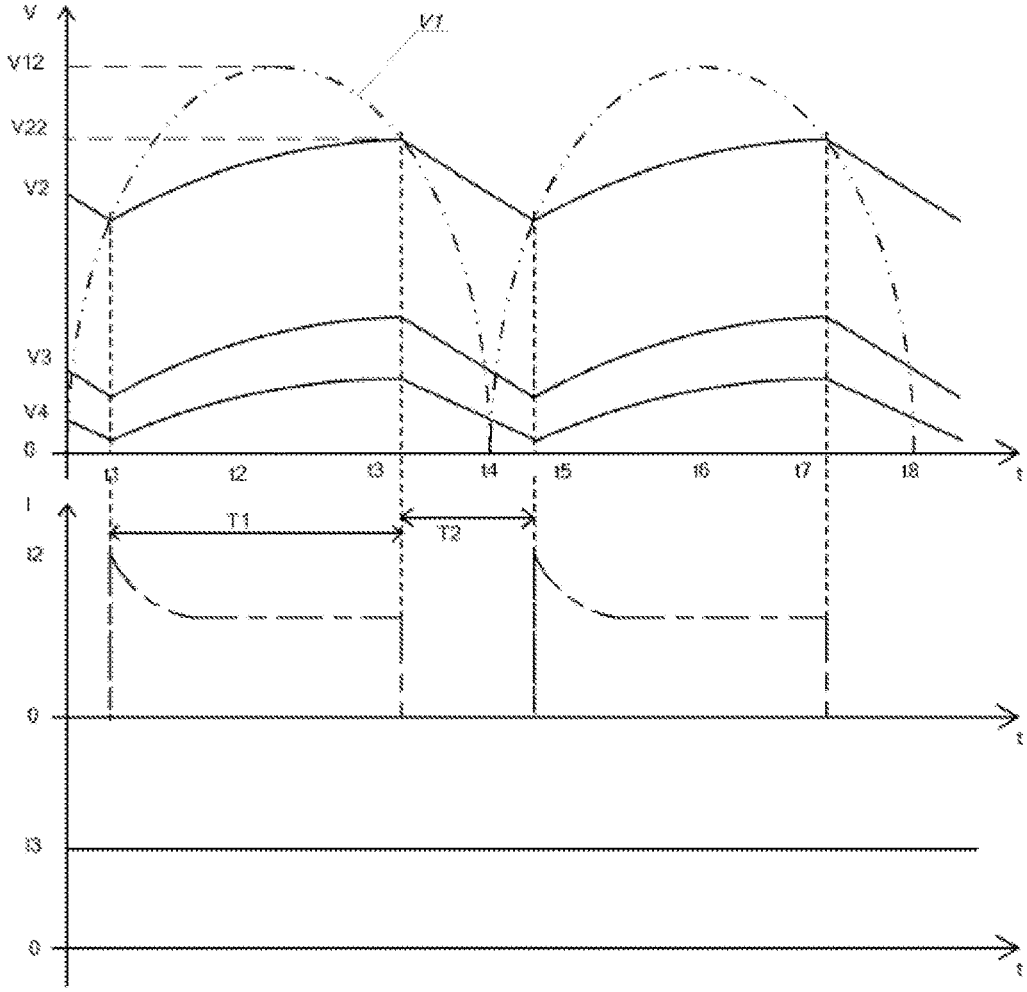
FIG. 11 is a waveform diagram illustrating the circuit of FIG. 10 when an input voltage of a power source is greater than a second threshold and smaller than a fourth threshold according to an example of the present disclosure.

FIG. 11 is a waveform diagram illustrating the circuit of FIG. 10 when an input voltage of a power source is greater than a second threshold and smaller than a fourth threshold according to an example of the present disclosure.

In FIG. 11, V1 refers to a rectified voltage of the input voltage, V2 refers to a voltage on the output end (i.e., the positive pole of the LED lamp string) of the current-limiting circuit 10, V3 refers to the first detection voltage having the same waveform as the voltage V2. After voltage division is performed by a resistor, the fluctuation of the second detection voltage V4 is smaller than the fluctuation of the first detection voltage V3, the fluctuation of a signal fed back from the detection and control circuit 30 to the current limiting circuit 10 is correspondingly reduced, the fluctuation of the output current I2 of the current-limiting circuit 10 is also correspondingly reduced, and the voltage drop on the detection and control circuit 30 remains stable. The current I3 in the LED lamp string remains as a constant value.

The second detection voltage V4 may be obtained by performing voltage division for the first detection voltage V3, and the second detection voltage V4 has corresponding smaller voltage fluctuation, so that the first output current I2 of the current-limiting circuit 10 has corresponding smaller voltage fluctuation. In this way, the current I3 on the LED lamp string and the voltage drop on the detection and control circuit 30 are relatively stable. Further, different voltage division ratios may be correspondingly adapted to different input voltages.

V. It can be known from the above that the smaller the fluctuation of the first detection voltage V3 is, the more stable the current output by the current-limiting circuit 10 becomes. To reduce the voltage fluctuation on the second detection voltage V4, a filter capacitor C1 may be added on the fourth end of the control circuit 70, and the stability of the second detection voltage V4 may, in turn, affect the stability of the first output current I2 and the second output current I5 of the current-limiting circuit 10.

A constant second detection voltage V4 may be obtained by filtering the second detection voltage V4, so that the first output current I2 of the current-limiting circuit 10 is also a constant value correspondingly, thereby ensuring that the current I3 on the LED lamp string is constant and the voltage drop on the detection and control circuit is stable.

Figure 12:
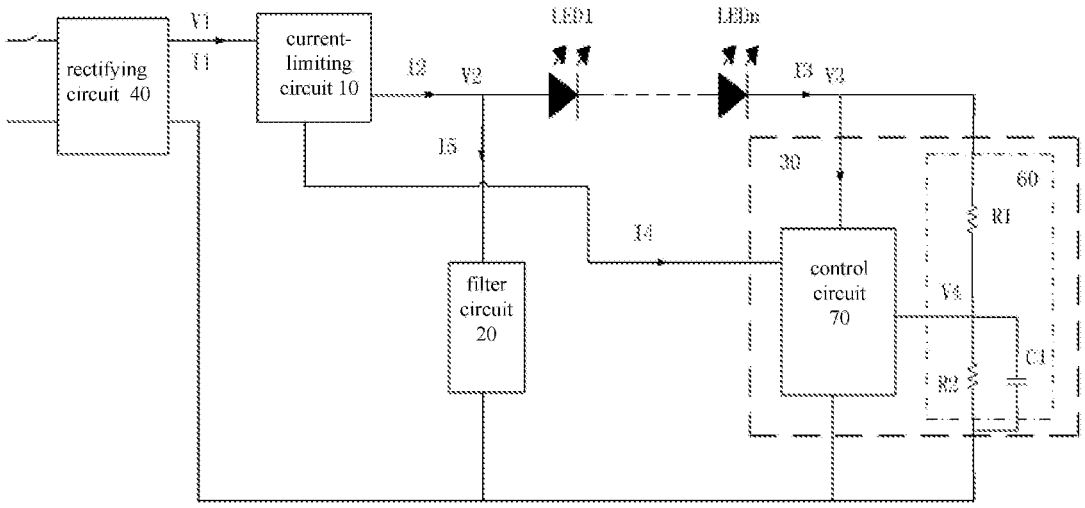
FIG. 12 illustrates another LED driving circuit according to a preferred example of the present disclosure.

FIG. 12 is a schematic diagram illustrating an LED driving circuit according to a preferred example of the present disclosure. It can be seen from FIG. 12 that a filter capacitor C1 is added in a sampling point of the voltage-dividing circuit, and the capacitor C1 is connected in parallel with the resistor R2. When the filter capacitor C1 is capable of filtering out the voltage fluctuation on the second detection voltage V4, a ripple of the voltage V4 may be neglected. The current waveform of the first output current I2 at different input voltages may be as shown in FIG. 13.

Figure 13:
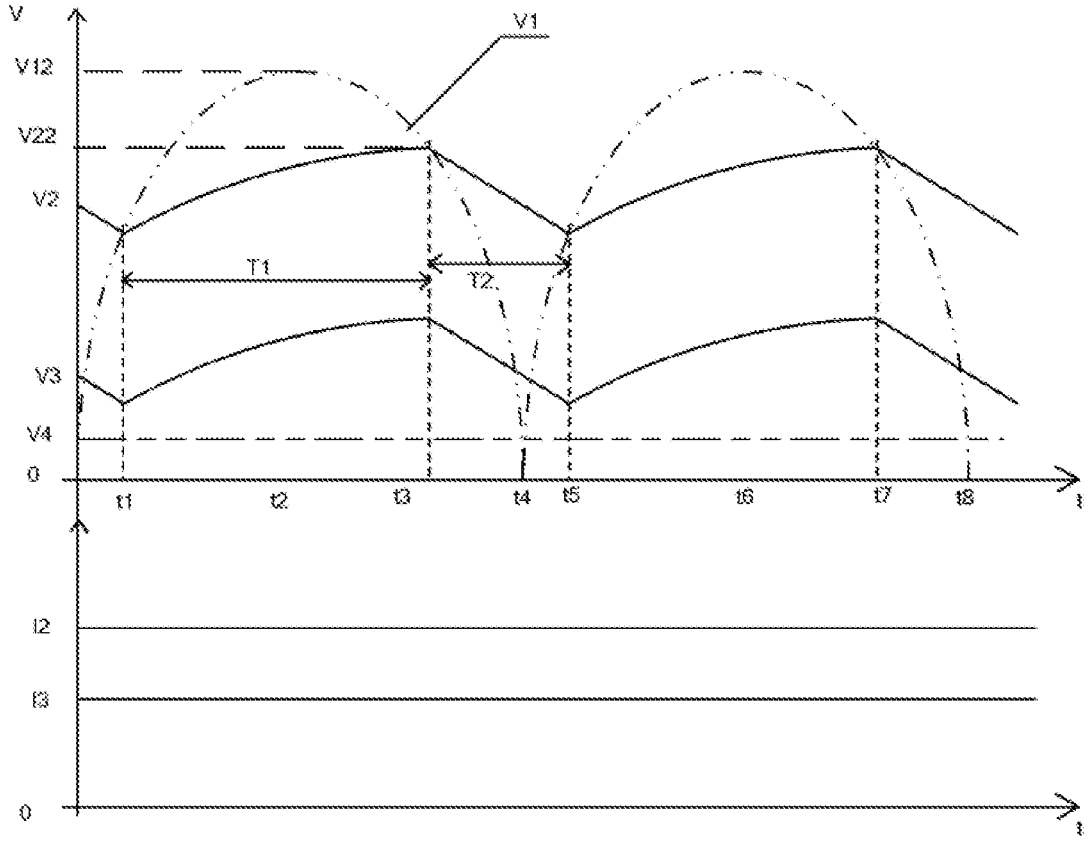
FIG. 13 is a waveform diagram illustrating voltages V2/V3 and currents I2/I3 on both ends of an LED lamp string in the circuit of FIG. 12 according to an example of the present disclosure.

FIG. 13 is a waveform diagram illustrating voltages V2/V3 and currents I2/I3 on both ends of an LED lamp string in the circuit of FIG. 12 according to an example of the present disclosure.

In FIG. 13, V1 refers to a voltage obtained by rectifying the input voltage of the power source, V2 refers to a voltage on the output end of the current-limiting circuit 10, V3 refers to a first detection voltage on the negative pole of the LED lamp string, V4 refers to a second detection voltage filtered again, I2 refers to a first output current of the current-limiting circuit 10, and I3 refers to a current on the LED lamp string.

Since the ripple of the second detection voltage V4 may be neglected, according to the second detection voltage V4 being a constant value, it is determined that the first output current I2 and the second output current I5 of the current-limiting circuit 10 are also constant values, so that the voltage V2 on the output end of the current-limiting circuit 10 is linearly increased or reduced, and the current I3 in the LED lamp string is also a constant value.

The second detection voltage V4 is a fifth constant value, and the second output current I5 flowing out of the current-limiting circuit 10 is also a constant value, and is a sixth constant value. According to the principle of the current-limiting circuit 10, the first output current I2 of the current-limiting circuit 10 is also a constant value, that is, a seventh constant value, and the current I3 in the LED lamp string is an eighth constant value.

When the input voltage is increased or reduced, the first detection voltage V3 changes within all set ranges, the second detection voltage V4 is a constant value and may correspondingly be moved up or down in parallel with the increase or decrease of the input voltage of the power source, and the constant value of the first output current I2 of the current-limiting circuit 10 and the constant value of the current I3 in the LED lamp string may also be correspondingly moved up or down.

In the solution of the present disclosure, the current-limiting circuit is provided on the output end of the rectifying circuit, the positive pole of the LED lamp string and the input end of the filter circuit, the detection and control circuit detects the voltage change in the negative pole of the LED lamp string at the time of controlling the current of LED lamp string, and controls the current-limiting circuit according to the voltage change in the negative pole of the LED lamp string. The current-limiting circuit controls the magnitude of the charge current of the filter circuit and the magnitude of the current in the LED lamp string according to the detected voltage change, which is detailed as follows.

When the input voltage of the power source is smaller than the third threshold V103, the current-limiting circuit is in an open state, the input voltage is applied to the filter circuit, the LED lamp string and the detection and control circuit, and the input current flows into the filter circuit and the LED lamp string; when the input voltage of the power source is greater than the third threshold V103 and smaller than the fourth threshold V104, the output current of the current-limiting circuit is reduced, that is, the charge current I4 of the filter circuit and the conduction current I3 of the LED lamp string are reduced, and the voltage drop on the detection and control circuit is reduced; at this time, the input current I1 of the power source is correspondingly reduced with the increase of the voltage of the power source. Since the output current I2 of the current-limiting circuit 10 is approximately equal to the input current I1 of the power source, the output current I2 of the current-limiting circuit 10 is correspondingly reduced with the increase of the input voltage of the current-limiting circuit 10, when the voltage of the power source is greater than the fourth threshold V104, the current-limiting circuit 10 maintains the charge current I4 of the filter circuit and the conduction current I2 of the LED lamp string as constant values. The input current I1 of the power source is the smallest at this time.

It is to be noted that the first threshold, the second threshold, the third threshold and the fourth threshold in the present disclosure are all preset.

Figure 14:
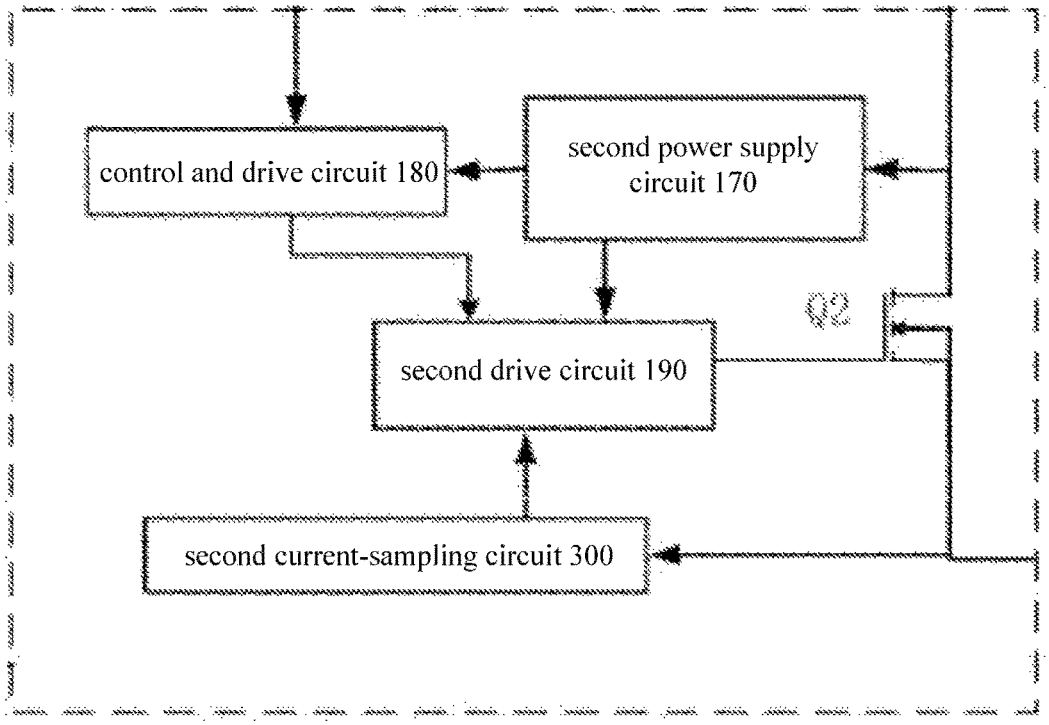
FIG. 14 is a schematic diagram illustrating a structure of a current-limiting circuit according to an example of the present disclosure.

As shown in FIG. 14, the current-limiting circuit 10 may include a second power supply circuit 170, a control and driving circuit 180, a second driving circuit 190, a second current-sampling circuit 300 and a power tube Q2, where the second driving circuit 190 is connected to the second power supply circuit 170, the control and driving circuit 180, the second current-sampling circuit 300 and a control end of the power tube Q2, and the second power supply circuit 170 is connected to the control and driving circuit 180.

Figure 15:
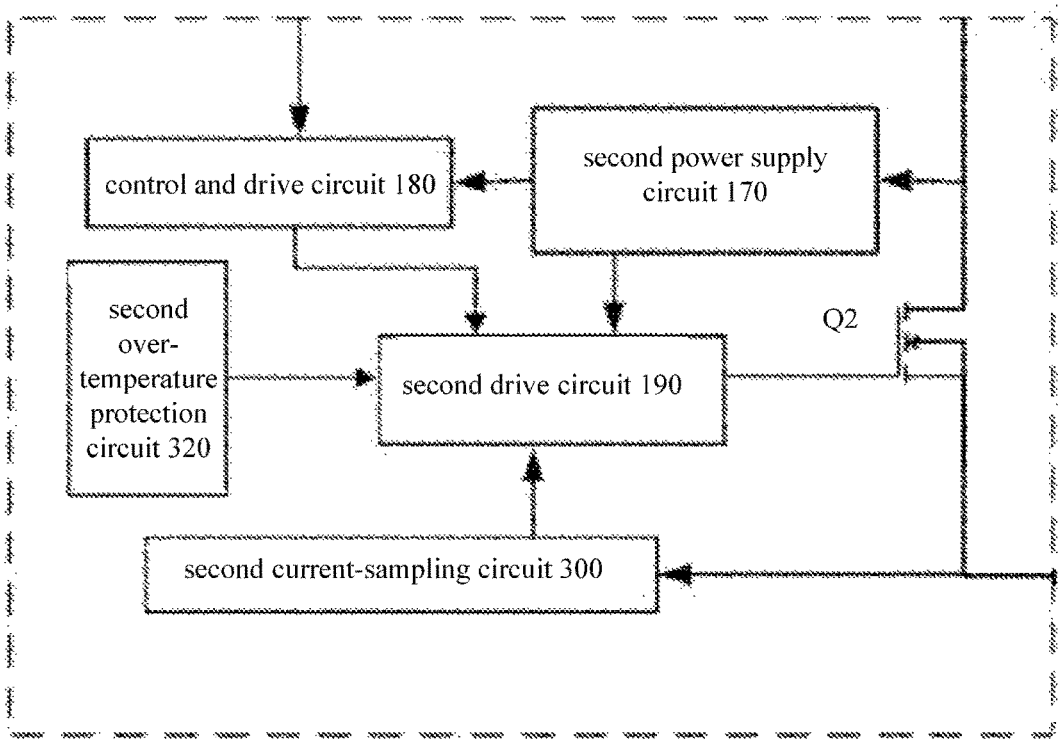
FIG. 15 is a schematic diagram illustrating a structure of a current-limiting circuit provided with an over-temperature protection circuit according to an example of the present disclosure.

As shown in FIG. 15, the current-limiting circuit 10 is provided with a second over-temperature protection circuit 320 connected with the second driving circuit 190 for performing over-temperature protection on the power tube Q2.

Figure 16:
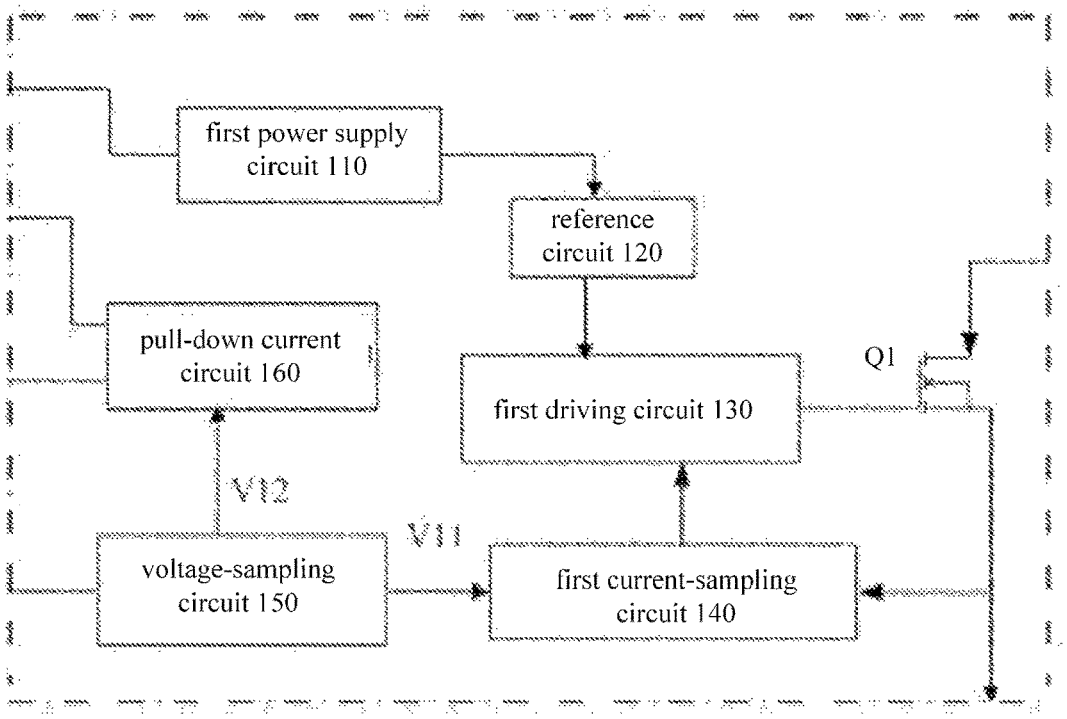
FIG. 16 is a schematic diagram illustrating a structure of a control circuit according to an example of the present disclosure.

As shown in FIG. 16, the control circuit 70 may include a first power supply circuit 110, a reference circuit 120, a first driving circuit 130, a first current-sampling circuit 140, a voltage-sampling circuit 150, a pull-down current circuit 160 and a power tube Q1, where the reference circuit 120 is connected to the first power supply circuit 110 and the first driving circuit 130, the first driving circuit 130 is connected to a control end of the power tube Q1 and the first current-sampling circuit 140, and the voltage-sampling circuit 150 is connected to the pull-down current circuit 160 and the first current-sampling circuit 140.

Figure 17:
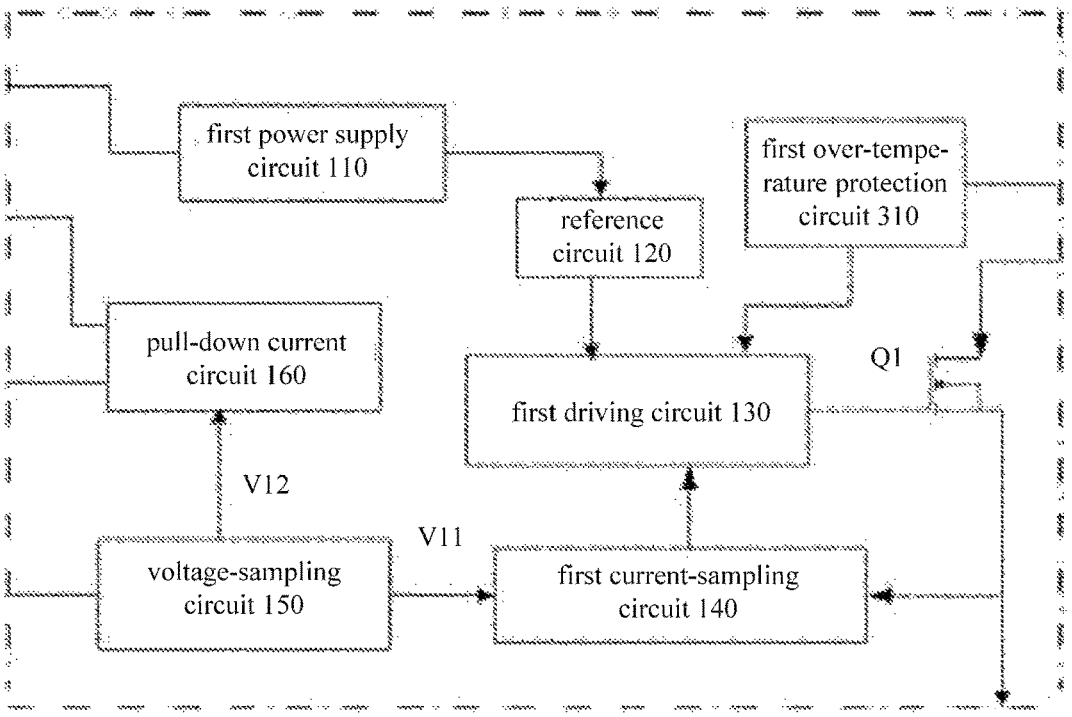
FIG. 17 is a schematic diagram illustrating a structure of a control circuit provided with an over-temperature protection circuit according to an example of the present disclosure.

As shown in FIG. 17, the control circuit 70 is provided with a first over-temperature protection circuit 310 connected with the first driving circuit 130 for performing over-temperature protection on the power tube Q1.

When the second detection voltage V4 belongs to a first set range, the voltage-sampling circuit 150 sends a V11 signal to the first current-sampling circuit 140, and the first driving circuit 130 controls the conduction of the power tube Q1 according to the V11 signal and a sampling result of the first current-sampling circuit 140, thereby controlling the magnitude of the current flowing through the LED lamp string.

When the second detection voltage V4 belongs to a second set range, the voltage-sampling circuit 150 sends a V12 signal to the pull-down current circuit 160, the pull-down current circuit 160 outputs an ICS signal to the control and driving circuit 180 according to the V12 signal, and the second driving circuit 190 controls the conduction of the power tube Q2 according to the output signal of the control and driving circuit 180, thereby controlling the input current of the power source.

The numerical value of the first set range is smaller than the numerical value of the second set range, or the numerical value of the first set range is partially overlapped with the numerical value of the second set range.

Preferably, the first set range is $0 \leqslant Vdim \leqslant 1.2V$, and the second set range is $1.2V \leqslant Vdim \leqslant 2.4V$.

When Vdim exceeds the second set range, the output of the pull-down current circuit 160 is maintained as a maximum value.

Although the present disclosure is described by the above examples, those skilled in the art may make a plurality of modifications and changes to the present disclosure without departing from the spirit of the present disclosure, and these modifications and changes should fall within the scope of the appended claims.

We claim:

1. A Light Emitting Diode (LED) driving circuit, comprising a rectifying circuit (40), a filter circuit (20), a current-limiting circuit (10), a detection and control circuit (30) and an LED lamp string, wherein, the rectifying circuit (40) is connected with an alternating-current power source, a negative pole of the rectifying circuit (40) is connected with a second end of the filter circuit (20) and a second end of the detection and control circuit (30); an input end of the current-limiting circuit (10) is connected with a positive pole of the rectifying circuit (40), a first output end of the current-limiting circuit (10) is connected with a positive pole of the LED lamp string and an input end of the filter circuit (20), and a second output end of the current-limiting circuit (10) is connected with a third end of the detection and control circuit (30); a negative pole of the LED lamp string is connected with an input end of the detection and control circuit (30);

wherein the detection and control circuit (30) detects a voltage V3 in the negative pole of the LED lamp string, and the voltage V3 is referred to as a first detection voltage; when the first detection voltage V3 is smaller than a third set voltage V33, a first output current I2 flowing out of the first output end of the current-limiting circuit (10) is a first constant current I21, the first constant current I21 supplies a charge current of the filter circuit (20) and a current I3 of the LED lamp string, the current I3 flowing through the LED lamp string is controlled by the detection and control circuit (30), no current is output from the second output end of the current-limiting circuit (10), and a second output current I5 is zero; when the first detection voltage V3 is greater than or equal to the third set voltage V33 and smaller than a fourth set voltage V34, the first output current I2 of the current-limiting circuit (10) is reduced with the increase of the first detection voltage V3, and at the same time, the second output current I5 flowing from the current-limiting circuit (10) to the detection and control circuit (30) is increased with the increase of the first detection voltage V3; when the first detection voltage V3 is greater than or equal to the fourth set voltage V34, the first output current I2 of the current-limiting circuit (10) remains as a second constant current I22, and the second output current I5 of the current-limiting circuit (10) remains as a third constant current I51; at this time, the second constant current I22 is a minimum current flowing from the current-limiting circuit (10) to the LED lamp string and the filter circuit (20), and the third constant current I51 is a maximum current flowing from the current-limiting circuit to the detection and control circuit (30).

2. The LED driving circuit according to claim 1, wherein the detection and control circuit (30) comprises a control circuit (70) and a voltage-dividing circuit (60), and the voltage dividing circuit (60) comprises voltage-dividing resistors R1 and R2 which are connected in series.

3. The LED driving circuit according to claim 2, wherein the second output end of the current-limiting circuit (10) is connected with a third end of the control circuit (70), and the negative pole of the LED lamp string is connected with an input end of the control circuit (70) and an input end of the resistor R1; the resistor R1 is connected in series with the resistor R2, and a fourth end of the control circuit (70) is connected with an output end of the resistor R1 and an input end of the resistor R2; the negative pole of the rectifying circuit (40) is connected with a second end of the control circuit (70) and an output end of the resistor R2.

4. The LED driving circuit according to claim 3, wherein a filter capacitor C1 is added on the fourth end of the control circuit (70), and the capacitor C1 is connected in parallel with the resistor R2.

5. The LED driving circuit according to claim 2, wherein the control circuit (70) comprises a first power supply circuit (110), a reference circuit (120), a first driving circuit (130), a first current-sampling circuit (140), a voltage-sampling circuit (150), a pull-down current circuit (160) and a power tube Q1, wherein the reference circuit (120) is connected to the first power supply circuit (110) and the first driving circuit (130), the first driving circuit (130) is connected to a control end of the power tube Q1 and the first current-sampling circuit (140), and the voltage-sampling circuit (150) is connected to the pull-down current circuit (160) and the first current-sampling circuit (140).

6. The LED driving circuit according to claim 5, wherein the control circuit (70) is provided with a first over-temperature protection circuit (310) connected with the first driving circuit (130).

7. The LED driving circuit according to claim 1, wherein the current-limiting circuit (10) is used to control a charge current of filter circuit (20) and a current I3 in the LED lamp string.

8. The LED driving circuit according to claim 1, wherein the detection and control circuit (30) is used to detect a current in the LED lamp string and control the current-limiting circuit (10) and the filter circuit (20) according to a detection result.

9. The LED driving circuit according to claim 1, wherein the current-limiting circuit (10) comprises a second power supply circuit (170), a control and driving circuit (180), a second driving circuit (190), a second current-sampling circuit (300) and a power tube Q2, wherein the second driving circuit (190) is connected to the second power supply circuit (170), the control and driving circuit (180), the second current-sampling circuit (300) and a control end of the power tube Q2, and the second power supply circuit (170) is connected to the control and driving circuit (180).

10. The LED driving circuit according to claim 9, wherein the current-limiting circuit (10) is provided with a second over-temperature protection circuit (320) connected with the second driving circuit (190).

11. A method of driving an LED driving circuit, wherein the LED driving circuit comprises a rectifying circuit (40), a filter circuit (20), a current-limiting circuit (10), a detection and control circuit (30) and an LED lamp string, the method comprising: using the detection and control circuit (30) to detect the first detection voltage V3 in the negative pole of the LED lamp string and control a magnitude of the current I3 flowing through the LED lamp string according to a magnitude of the first detection voltage V3, wherein when the first detection voltage V3 is smaller than a first set voltage value V31, no current flows through the LED lamp string, the first output current I2 of the current-limiting circuit (10) is a first constant current I21 used for charging a capacitor in the filter circuit (20) and at this time, a charge current I4 of the filter circuit (20) is the largest, and the second output current I5 of the current-limiting circuit (10) is zero; wherein when the first detection voltage V3 is equal to the first set voltage V31, the LED lamp string is conducted, there is a current flowing through the LED lamp string and at this time, the first output current I2 flowing out of the current-limiting circuit (10) remains as the first constant current I21, wherein the first constant current I21 is divided into two parts, one part of which is used for charging the filter circuit (20), and the other part flows through the LED lamp string for turning on the LED lamp string, and the second output current I5 of the current-limiting circuit (10) continues to be zero; wherein when the first detection voltage V3 is greater than a first set voltage V31 and smaller than a second set voltage V32, the first output current I2 flowing out of the current-limiting circuit (10) continues to remain as the first constant current I21 and with the increase of the first detection voltage V3, the current I3 flowing through the LED lamp string is increased, the charge current I4 of the filter circuit (20) is reduced and the second output current I5 of the current-limiting circuit (10) continues to be zero; wherein when the first detection voltage V3 is greater than or equal to the second set voltage V32 and smaller than a third set voltage V33, the first output current I2 flowing out of the current-limiting circuit (10) is the first constant current I21, the current I3 flowing through the LED lamp string under the control of the detection and control circuit (30) is a fourth constant current I32, and at this time, the fluctuation of the first detection voltage V3 does not cause the fluctuation of the current I3, and the second output current I5 of the current-limiting circuit (10) continues to be zero; wherein when the first detection voltage V3 is greater than or equal to the third set voltage V33 and smaller than a fourth set voltage V34, the first output current I2 flowing out of the current-limiting circuit (10) is reduced with the increase of the first detection voltage V3 and at the same time, the detection and control circuit (30) draws the second output current I5 from the current-limiting circuit (10), the second output current I5 flowing from the current-limiting circuit (10) to the detection and control circuit (30) is increased with the increase of the first detection voltage V3, the current I3 flowing through the LED lamp string under the control of the detection and control circuit (30) remains as the fourth constant current I32, and the second output current I5 is far smaller than the first output current I2; and wherein when the first detection voltage V3 is greater than or equal to the fourth set voltage V34, the first output current I2 flowing out of the current-limiting circuit (10) remains as a second constant current I22, the second output current I5 flowing out of the current-limiting circuit (10) remains as a third constant current I51 and at this time, the second constant current I22 is a minimum current flowing from the current-limiting circuit to the LED lamp string and the filter circuit (20), the third constant current I51 is a maximum current flowing from the current-limiting circuit to the detection and control circuit (30), and the third constant current I51 is far smaller than the second constant current I22.

12. The method according to claim 11, wherein a second detection voltage V4 is obtained by performing voltage division for the first detection voltage V3, and the voltage fluctuation of the second detection voltage V4 is correspondingly reduced in such a way that the fluctuation of the first output current I2 of the current-limiting circuit (10) is reduced correspondingly, and the current I3 on the LED lamp string and a voltage drop on the detection and control circuit (30) are relatively stable; further, different voltage division ratios may be correspondingly adapted to different input voltages.

13. The method according to claim 12, wherein a constant second detection voltage V4 is obtained by filtering the second detection voltage V4 in such a way that the first output current I2 of the current-limiting circuit (10) is a constant value correspondingly, thereby ensuring that the current I3 on the LED lamp string is constant and the voltage drop on the detection and control circuit (30) is stable.

* * * * *